US005469665A

United States Patent [19]

Biebuyck

[11] Patent Number: 5,469,665

[45] Date of Patent: Nov. 28, 1995

[54] THRESHOLD SYSTEM

[75] Inventor: Lawrence Biebuyck, Garland, Tex.

[73] Assignee: Butler Manufacturing Corporation, Kansas City, Mo.

[21] Appl. No.: 140,213

[22] Filed: Oct. 21, 1993

[51] Int. Cl.[6] ..... E06B 1/70

[52] U.S. Cl. ..... 49/470

[58] Field of Search ..... 49/470, 469, 467, 49/468, 471

[56] References Cited

U.S. PATENT DOCUMENTS

| | | | |
|---|---|---|---|
| 1,671,349 | 5/1928 | Crist . | |
| 2,319,709 | 5/1943 | Spraragen . | |
| 2,739,357 | 3/1956 | Seabrook . | |
| 3,142,097 | 7/1964 | Oehmig | 49/469 X |
| 3,987,587 | 10/1976 | Miller . | |
| 4,185,417 | 1/1980 | McKann | 49/470 |
| 4,411,104 | 10/1983 | St. Aubin . | |
| 4,413,446 | 11/1983 | Dittrich . | |
| 4,686,793 | 8/1987 | Mills . | |
| 4,807,396 | 2/1989 | Heikkinen | 49/470 |
| 5,067,279 | 11/1991 | Hagemeyer . | |

FOREIGN PATENT DOCUMENTS

| | | | |
|---|---|---|---|
| 1583686 | 1/1981 | United Kingdom | 49/470 |

OTHER PUBLICATIONS

Zero International Catalog, pp. 13 and 14.
Zero Weather Stripping Co., Inc., "Stripping by Zero" Catalog, 1980, p. 11.
Pemko Catalog, pp. 12–14, 22, 37, 40.

*Primary Examiner*—Philip C. Kannan
*Attorney, Agent, or Firm*—Jenkens & Gilchrist

[57] ABSTRACT

A threshold system for a door incorporating a seal and a threshold plate. The seal mounts to the door and has a flap extending therebeneath. The threshold plate has a raised inner section connected to a recessed outer section by an upstanding lip. The threshold plate disposed below the door so that the flap of the seal contacts with the upstanding lip of the threshold plate, thereby creating a seal between an outside area and an inside area. An outer deflector is mounted on the door body to deflect air and moisture away from the threshold plate and seal.

67 Claims, 2 Drawing Sheets

THRESHOLD SYSTEM

BACKGROUND OF THE INVENTION

1. Field of the Invention

The present invention relates to door assemblies and, more particularly, to door thresholds and sealing members therefor.

2. History of the Prior Art

The use of thresholds in residential and commercial buildings is an integral part of conventional construction. External doors are most effectively mounted in conjunction with a lower plate or threshold member above which the door may be oriented in the closed position. The threshold serves multiple functions. It reduces the distance between the surface above which the door swings and the bottom of the closed door and it functions as a barrier to air and moisture infiltration. In some designs, sealing members are incorporated with the door to further reduce, or substantially eliminate, moisture infiltration under the closed door.

Prior art thresholds have incorporated a variety of designs. Common styles include elongate and tapered configurations in a variety of shapes and sizes adapted for positioning beneath the swinging door. In the main, the thresholds include a first portion adapted for facing the interior of the building as defined by the threshold and door assembly. A second portion faces outwardly from the building. The outwardly facing portion is generally designed to repel water and inhibit the infiltration of air therebeneath. The threshold is thus conventionally made of wood or metal and assembled to withstand inclement weather without readily deteriorating. Metal thresholds are generally best suited for resisting prolonged moisture without structural degradation. Usually, the metal thresholds are formed with a hollow space therebeneath to reduce cost and weight to maximize design effectiveness. Design parameters for the threshold also include its length, width, cross-sectional shape, manner of securement to the underlying floor, and manner of sealing engagement with the door disposed thereabove.

Present day threshold sealing systems have advanced in design to improve the efficiency of sealing and door operation. The systems often include gaskets and flanges which may be secured to the bottom of the door. Many of these sealing members effectively prevent infiltration of moisture except when the door is moving to a closure position. Unfortunately, in certain instances the sealing member can actually sweep moisture off of the threshold into the building area. The intent of the sealing members is, of course, to resist the intrusion of water as well as wind loading, driving rain, and thermal degradation.

Several U.S. Patents have addressed these issues. For example, U.S. Pat. No. 4,413,446 illustrates a threshold assembly for mounting on a door and door sill utilizing a flexible magnet holding device for enhanced reliability against water infiltration. The magnets described therein are constructed so that the opposed edges have opposite polarity. Such sealing weather stripping closures have been the subject of other design efforts. For example, U.S. Pat. No. 4,411,104 teaches a door bottom and sill assembly. The sill portion of this particular structure mates with a sealing member when the door is in a closed position forming a weather barrier. Likewise, U.S. Pat. No. 2,739,357 teaches a combined weather stop and scuff plate for closure devices. In this particular design the threshold is constructed to engage a sealing member projecting downwardly from the door in a configuration enhancing the sealing thereof. Similarly, U.S. Pat. No. 2,319,709 teaches a sealing strip for use with moveable closures such as doors or windows to seal the clearance spaces around such structures. In these prior art references, the sealing lips are often angulated with the sealing members forming rather large sealing surfaces with the jamb region extending outwardly from beneath the door. Such structures can, however, create water infiltration problems because water can accumulate in areas prone to the movement of water into the structure.

It would be an advantage to overcome the problems of prior art systems by providing a threshold assembly capable of providing an improved system for preventing moisture and air infiltration while overcoming the disadvantages of the prior art. The present invention provides such a system by incorporating a threshold containing a sealing lip adapted for engaging a sealing member secured to the door and an outer recessed threshold region for substantially reducing the amount of water that could be swept in by the door.

SUMMARY OF THE INVENTION

The present invention relates to threshold sealing systems. More particularly, the present invention comprises a threshold assembly having improved moisture and air infiltration sealing. The present invention includes a threshold plate disposed beneath a door, and sealing flap depending from a lower area of the door for engagement with the threshold plate. The threshold plate has a raised inner section disposed towards the inside area of a building and connected by an upstanding lip to a recessed outer section. The seal flap and upstanding lip plate are adapted and located to allow the seal flap to contact the upstanding lip with horizontally directed force. The contact between the seal flap the upstanding lip creates a seal between the outside area and the inside area.

In one aspect of the present invention, a deflector shield is disposed on a lower outside area of the door, and is adapted for deflecting moisture and air away from the threshold plate and seal flap. In yet a further aspect, the recessed outer section of the threshold plate does not extend beyond the deflector shield into the outside area.

In another aspect of the present invention, the seal flap contacts the upstanding lip above the recessed outer section. In this manner, the seal flap does not contact any moisture clinging to the recessed outer section as the door is opened and closed.

In yet another aspect of the present invention, the seal flap does not contact the recessed outer section. In this manner, the seal flap does not wear by rubbing the recessed outer section as the door is opened and closed.

In yet another aspect of the present invention, the recessed outer section of the threshold plate does not extend past the door into the outside area. In this manner, moisture running down the door does not accumulate on the threshold plate permitting the water to seep past the seal into the inside area.

In yet another aspect of the present invention, the recessed outer section of the threshold plate is angled downward as the recessed outer section progresses from the upstanding lip to the outside area. In this manner, any moisture that comes in contact with the recessed outer section will shed away from the inside area and towards the outside area. The angle prevents water from accumulating near the contact of seal flap to the upstanding lip and avoids having the seal flap sweep water into the building from the threshold when the door is opened and closed.

In yet another aspect of the present invention, the seal flap engages the upstanding lip with sufficient height above the recessed outer section, and sufficient overlap on the upstanding lip, to allow adjustment of the door without losing sealing contact of the seal flap and the upstanding lip.

In yet another aspect of the present invention, a seal channel is secured to the door for securing the seal. The seal channel is a specific contour, and the seal is of a matching upper seal profile, so that the seal can be slid into the sealing channel for securing the seal to the door. In this manner, the seal can be replaced without removal and replacement of the hardware. In yet a further aspect, the seal channel is removably mounted to the door. In this manner a seal channel can be added to doors without seal channels, or, doors having a seal channel can have those seal channels easily replaced.

In yet another aspect of the present invention, an upper portion of the seal flap is secured to the door. A means for transferring horizontal forces between the seal flap and the door is disposed below the location where the seal flap is secured to the door. In this manner, the seal flap exerts continuous sealing contact with the upstanding lip of the threshold. Also, stress forces in the sealing flap are reduced in the area where the seal flap is secured to the door, thereby increasing the life of the seal flap.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
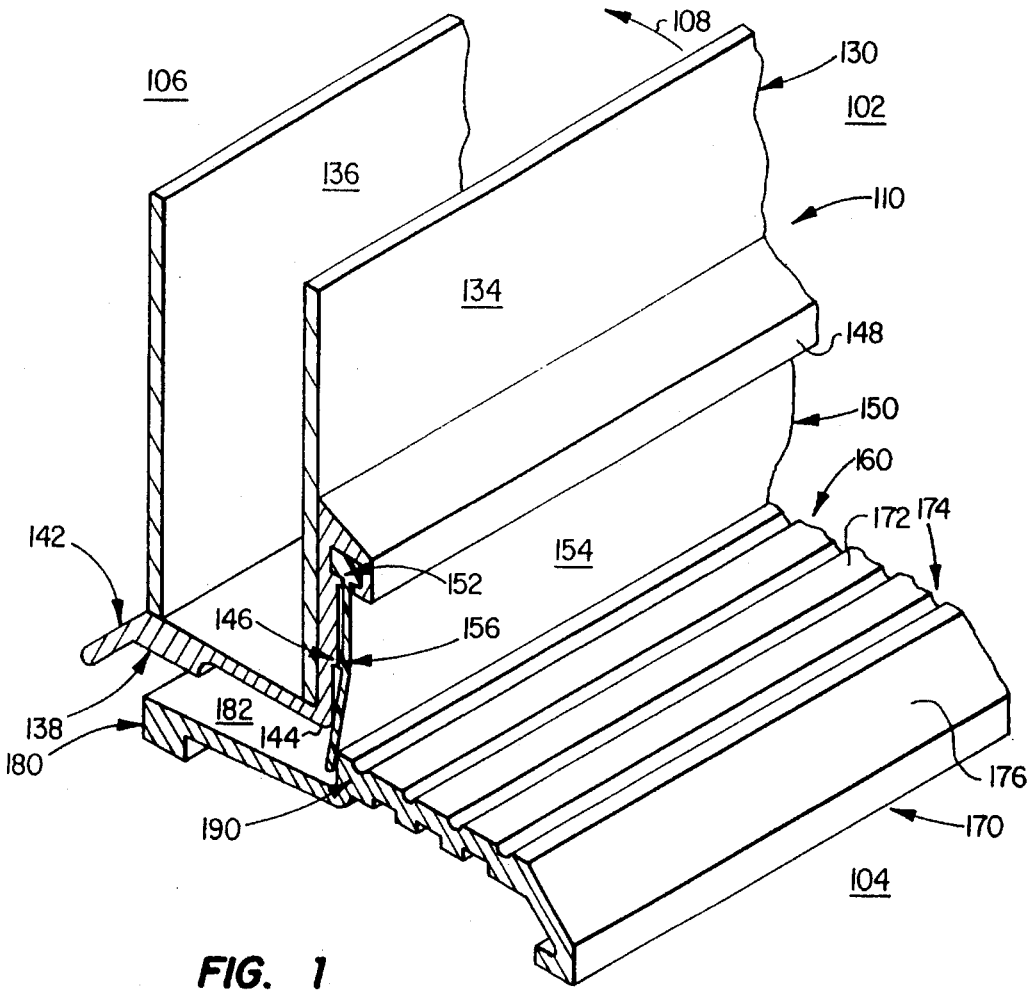
FIG. 1 is a fragmentary, perspective view illustrating a cross sectional configuration of one embodiment of the present invention.

Referring first to FIG. 1, there is shown an improved threshold assembly 110 constructed in accordance with the principles of the present invention. The threshold assembly 110 separates an inside area 102 of a building 104 from an outside area 106. The threshold assembly 110 generally includes a threshold plate 160, and a seal 150 attached to a door 130. The door 130 is pivotally connected to the building 104 at a side edge (not shown), in a conventional manner to allow the door 130 to pivot open in a direction 108 towards the outside area 106. The pivotal engagement may be provided by commercially available hinges, or the like, and is discussed for purposes of illustration only. The pivotal engagement is not itself integral to, or limiting of, the present invention. As a further example, the threshold assembly 110 can be used with a door engaged by a pivotal engagement which swings in another direction, by a sliding means, or by any other means of engagement.

Still referring to FIG. 1, the door 130 generally includes a bottom rail adaptor 138, and an inner panel 134 and an outer panel 136 connected to the bottom rail adaptor 138. The bottom rail adaptor 138 seals the space between the inner panel 134 and the outer panel 136. The bottom rail adaptor 138 may be extruded aluminum or the like, and the inner panel 134 and the outer panel 136 may be sheet metal or the like. The basic door construction, using a bottom rail adaptor, an inner panel, an outer panel, is shown for purposes of illustration only and is not itself integral to, or limiting of, the present invention. As an example, the present invention can be incorporated into a solid door, or can be part of a separate assembly that is attached to an existing door of any type construction.

Referring still to FIG. 1, the bottom rail adaptor 138 in the present invention generally includes a deflector shield 142, a lower inside edge, a door seal ledge 146, and a seal channel 148. The deflector shield 142 is located on side of the door 130 facing the outside area 106, and extends along the bottom of the bottom rail adaptor 138. The lower inside edge 144 is located on the side of the door 130 facing the inside area 102, and extends along the bottom of the bottom rail adaptor 138. Above the lower inside edge 144, the bottom rail adaptor 138 projects horizontally in the direction of the inside area 102, thereby creating the door seal ledge 146. The seal channel 148 is disposed on the same side of the door 130 as the inside area 102, extending parallel to, and above, the door seal ledge 146. The deflector shield 142, the door seal 1 edge 146, and the seal channel 148 are shown as components of the bottom rail adaptor 138 for purposes of illustration only. Incorporating these features as part of the bottom rail adaptor 140 is not integral to, or limiting of, the present invention. As an example, any or all of these components could be added separately to the door 130 or could be part of a separate unit removably attached to the door 130.

Still referring to FIG. 1, the seal 150 is of an elongated construction, generally having an upper seal profile 152, a seal flap 154, and a seal leg 156. The upper seal profile 152 is contoured to engage the seal channel 148 of the bottom rail adaptor 138 and secure the seal 150 thereto. The seal flap 154 is disposed below the upper seal profile 152 and extends below the door 130 for sealing engagement with the threshold plate 160, as will be described below. The seal leg 156 projects horizontally from the seal flap 154, contacts the bottom rail adaptor 138 immediately above the door seal ledge 146, and extends parallel to the door seal ledge 146. The seal 150 may be formed of an elastomeric material or the like.

Referring still to FIG. 1, the threshold plate 160 comprises a raised inner section 170, and a recessed outer section 180 connected by an upstanding lip 190 to the raised inner section 170. The raised inner section 170 is disposed in the inside area 102 of the building 104. A raised top surface 172 of the raised inner section 170 has a plurality of threshold groves 174 formed therein. At the edge of the raised inner section 170 facing the inside area 102, there is an angulated internal lip 176 which progresses downward from the raised top surface 172 to the floor of the building 104. The recessed outer section 180 of the threshold plate 160 is formed with a recessed top surface 182 that is disposed at a level that is lower than, or depressed from, the raised top surface 172. The recessed top surface 182 also has a slight angle that slopes downward as the recessed top surface 182 progresses from the raised inner section 170 towards the outside area 106. The threshold plate 160 may be fabricated from extruded aluminum or the like.

Still referring to FIG. 1, it can be seen how the threshold system 110 operates. The deflector shield 142 directs moisture and air breezes away from, and in front of, the threshold system 110. Moisture running down the door 130 will not drip onto the threshold plate 160 because the recessed outer section does not extend into the outside area 106. The slight angle of the recessed top surface 182 causes any moisture on the recessed top surface 182 to run away from the upstanding lip 190. The seal flap 154 extends below the door 130 and contacts the upstanding lip 190, thereby creating a seal between the inside area 102 and the outside area 106. The upstanding lip 190 creates a height differential between the raised inner section 170 and the recessed outer section 180. In addition to breaching the seal created by the seal flap 154 and the upstanding lip 190, moisture and air must overcome this height differential created by the upstanding lip 190 in order to infiltrate into the inside area 102. Also, moisture and air from the outside area 106 attempting to reach the inside area 102, will place a pressure against the seal flap 154, thereby increasing the sealing contact pressure between the seal flap 154 and the upstanding lip 190.

Figure 2:
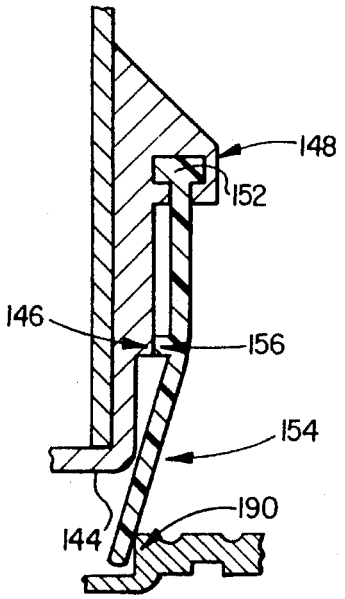
FIG. 2 is a fragmentary, cross sectional, side view of the seal in the embodiment of FIG. 1.

Referring now to FIGS. 1 and 2 in combination, it can be seen that the seal 150 is designed to exert continuous sealing contact between the threshold plate 160 and the door 130. The seal channel 148 secures the upper seal profile 152 of the seal 150 to the bottom rail adaptor 138. The seal leg 156 contacts the bottom rail adaptor 138 immediately above the door seal ledge 146, transferring only horizontal forces between the bottom rail adaptor 138 and the seal 150. The seal flap 154 will usually not contact the lower inside edge of the bottom rail adaptor 138, however, any contact that may occur will transfer only horizontal and vertical forces, if any, between the seal 150 and the bottom rail adaptor 138. Finally, the seal flap 154 contacts the upstanding lip 190 of the threshold, transferring only horizontal and vertical forces between the threshold plate 160 and the seal 150. In this manner, the seal 150 exerts continuous contact force against both the threshold plate 160 and the door 130. The continuous contact between the seal 150, the threshold plate 160, and the door 130, creates a seal between the inside area 102 and the outside area 106. Furthermore, because the seal 150 transfers horizontal and vertical forces to the bottom rail adaptor 130 through the seal leg 156 and the seal flap 154, stress concentrations are reduce in the seal 150 at the location where the seal flap 150 extends from the upper seal profile 152 and the seal channel 148. This reduced stress concentration increases the life of the seal 150.

Referring back to FIG. 1, because the upstanding lip 190 is a vertical wall, the seal flap 154 will seal against the vertical surface of the upstanding lip 190 and leave a small gap between the seal flap 154 and the recessed top surface 182. This small gap allows the door 130 to swing open and close without sweeping any moisture that may exist on the recessed top surface 182 into the inside area 102. This small gap will also prevent wear of the seal 150 caused by the rubbing of the seal flap 154 against the recessed top surface 182 as the door 130 is opened and closed.

Still referring back to FIG. 1, the seal flap 154 and the upstanding lip 190 have an overlapping area. The gap between the seal flap 154 and the recessed top surface 182, and the overlapping area between the seal flap 154 and the upstanding lip 190, are sufficient to allow adjustment of the squareness of the door 130 without losing any sealing properties.

Referring still back to FIG. 1, it can be seen that the seal channel 148 and upper seal profile 152 arrangement allows the replacement of the seal 150 without use of screws or other fastening devices. Replacement of the seal 150 is accomplished by sliding the seal 150 out of the seal channel 148. A replacement seal can then be slid back into position by sliding the upper seal profile of the replacement seal into the seal channel 148.

Figure 3:
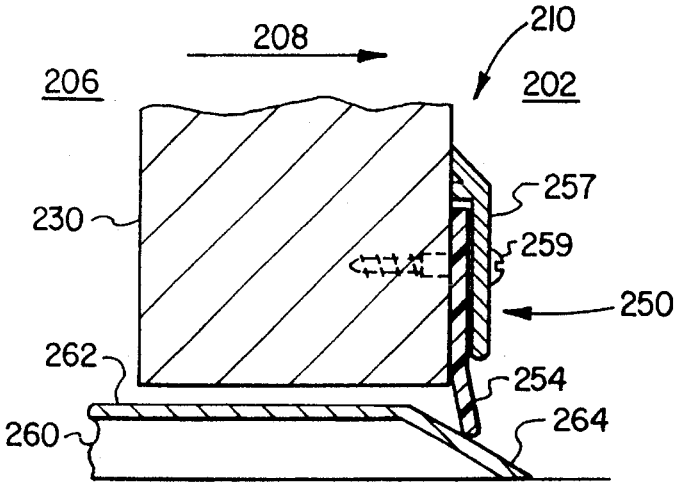
FIG. 3 (PRIOR ART)
FIG. 3 is a side elevation cross sectional view of a prior art threshold assembly.

In comparison to the prior art, the above described invention is a marked advantage. FIG. 3 illustrates a prior art threshold assembly 210. The prior art threshold assembly 210 separates an inside area 202 from an outside area 206. The prior art threshold assembly 210 includes a threshold plate 260 and a seal assembly 250 attached to a door 230. The threshold plate 260 has a threshold surface 262 that extends beyond the door 230 into the outside area 206. An angulated lip 264 on the threshold plate 260 is disposed towards the inside area 202. The seal assembly 250 has a seal flap 254 that is held against the door 230 by a retainer 257 and a plurality of screws 259. When installed, the seal flap 254 of the seal assembly 250 extends below the door 230 and contacts the angulated lip 264 of the threshold plate 260. The contact between the seal flap 254 and the angulated lip 264 creates a seal between the inside area 202 and the outside area 206. Because the seal flap 254 contacts the angulated lip 264 below the highest portion of the threshold plate 260, a lower region is created between the seal flap 254 and the angulated lip 264 of the threshold plate 260.

Still referring to FIG. 3, it can be seen that moisture running down the outside of the door 230 will drip onto the threshold surface 262 below. Because the threshold surface 262 is level, moisture on the threshold surface 262 will be allowed to run toward the seal flap 154. The lower region between the angulated lip 264 and the seal flap 254 will allow the accumulation of moisture from the outside area 206. Upon opening the door 230 in a direction 208, any moisture accumulated in the lower region between the seal flap 254 and angulated lip 264 will pour into the inside area 202. Also, moisture and air will press against the seal flap 254 when attempting to infiltrate the inside area 202 from the outside area 206. This pressure against the sealing flap 254 will reduce the contact pressure between the seal flap 254 and the angulated lip 264, thereby allowing infiltration of the moisture and air. Finally, replacement of the seal flap 254 requires removal and replacement of the screws 259 and the retainer 257.

In contrast, the present invention, as illustrated in FIG. 1, is a marked improvement over the prior art threshold assembly 210. Referring back to FIG. 1, the deflector shield 142 will deflect moisture and air from the threshold assembly 110. Moisture running down the door 130 will not drip onto the threshold plate 160 because the recessed outer section 180 does not extend into the outside area 206. Any moisture that might reach the recessed outer section 180 of the threshold plate 160, will shed towards the outside area 106 because of the incline of the recessed top surface 182. There are no lower regions in the threshold assembly 110 to collect moisture, and, any moisture or air attempting to reach the inside area 102 must overcome gravity and rise up over the upstanding lip 190. Also, moisture and air attempting to infiltrate from the outside area 106 will press against the seal flap 154 and increase the contact pressure between the seal flap 154 and the upstanding lip 190, thereby further preventing the infiltration of the moisture and air. Furthermore, replacement of the seal 150 does not necessitate removal of screws or retainer devices, but merely sliding the seal 150 out of the seal channel 148 and sliding the new seal into the same position.

Figure 4:
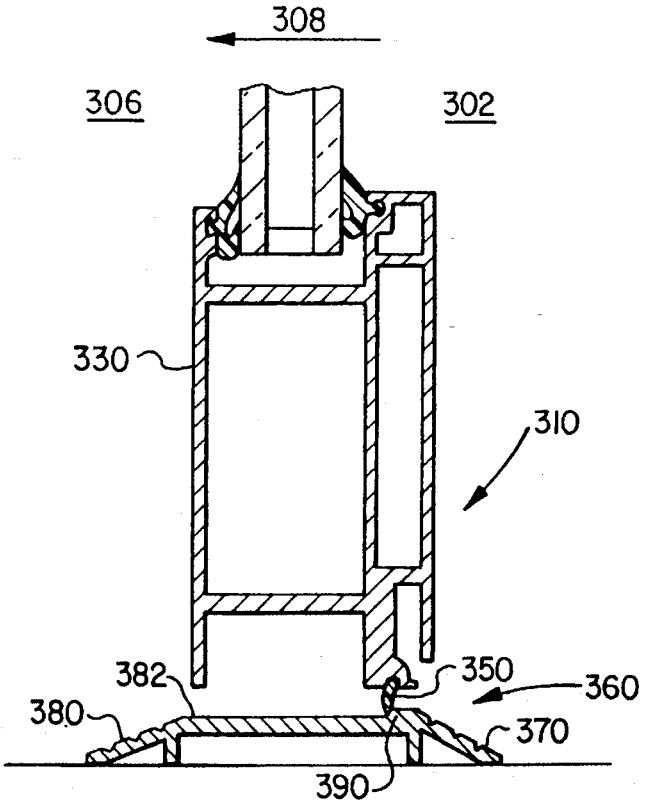
FIG. 4 (PRIOR ART)
FIG. 4 is a side elevation cross sectional view of an alternate prior art threshold assembly.

Referring now to FIG. 4, there is illustrated an alternate prior art threshold assembly 310. The alternate prior art threshold assembly 310 separates an inside area 302 from an outside area 306. The alternate prior art threshold assembly 310 includes a seal 350 attached to the door 330 which is adapted for contact with a threshold plate 360 disposed therebeneath. The door 330 swings in a direction 308 to open. The threshold plate 360 has a raised inner section 370 connected by an upstanding lip 390 to a recessed outer section 380. The recessed outer section 380 has a recessed top surface 382 that is level and extends beyond the door 330 into the outside area 306. The seal 350 contacts the upstanding lip 390 and the recessed top surface 382 of the threshold plate 360, thereby sealing the inside area 302 from the outside area 306.

Still referring to FIG. 4, it can be seen that moisture running down the door 330 will drip onto the recessed outer section 380 of the threshold plate 360. Because the recessed top surface 382 is level, moisture will be allowed to collect on the recessed top surface 382. Because the seal 350 contacts the recessed top surface 382, the seal 350 will sweep moisture off of the recessed top surface 382 and into the inside area 302 as the door 330 is opened and closed. Also, because the seal flap 350 contacts the recessed top surface 382, the seal 350 will wear from rubbing against the recessed top surface as the door 330 is opened and closed. Furthermore, the squareness of the door 330 cannot be adjusted without losing the sealing contact between the seal 350 and the threshold plate 360 because of the absence of a gap between the seal 350 and the recessed top surface 382, and the relatively small overlap between the upstanding lip 390 and the seal 350.

In contrast, the present invention, as illustrated in FIG. 1, is a marked improvement over the alternate prior art threshold 310. Referring back to FIG. 1, the deflector shield 142 deflects moisture and air breezes from the threshold assembly 110. Moisture running down the door 130 will not drip onto the threshold plate 160 because the recess outer section 180 does not extend into the outside area 106. Because of the angle in the recessed top surface 182, any moisture reaching the recessed outer section 180 will shed away from the inside area 102 and towards the outside area 106. The gap between the seal flap 154 and the recessed top surface 182 prevents the seal flap 154 from sweeping any moisture that might be clinging to the recessed top surface 182 into the inside area as the door 130 is opened and closed. The gap between the seal flap 154 and the recessed top surface 182 will also prevent wear to the seal flap 182 caused by the seal flap rubbing against the recessed top surface 182 as the door 130 is opened and closed. Furthermore, the relatively larger overlap between the seal flap 154 and the upstanding lip 190, and the gap between the seal flap 154 and the recessed outer section 180, allows adjustment of the door 130 for squareness without loss of the seal between the seal flap 154 and the upstanding lip 190 of the threshold plate 169.

It is thus believed that the operation and construction of the present invention will be apparent from the foregoing description. While the method and apparatus shown or described has been characterized as being preferred it will be obvious that various changes and modifications may be made therein without departing from the spirit and scope of the invention as defined in the following claims.

What is claimed is:

1. An improved threshold system for sealing an inside area of a building from an outside area thereof, of the type wherein a threshold plate is disposed beneath a door, wherein the improvement comprises:

a seal flap depending from a lower area of said door, said seal flap having a first surface facing said inside area, a second surface facing said outside area and a bottom;

a deflector shield disposed on a lower area of said door facing said outside area, said deflector shield being located for deflecting moisture and air away from said threshold system;

said threshold plate having a raised inner section connected by an upstanding lid to a recessed outer section, said upstanding lip being located for engaging said first surface of said seal flap, thereby sealing said outside area from said inside area; and wherein said seal flap and said upstanding lip are located for an engagement which allows sufficient space between the bottom of said seal flap and a top surface of said recessed outer section, and sufficient overlap between said seal flap and said upstanding lip, so that the squareness of said door can be adjusted without loss of sealing contact between said seal flap and said upstanding lip.

2. The improved threshold system as in claim 1, wherein said bottom of said seal flap contacts said upstanding lip above said recessed outer section with sufficient height so that the seal flap does not contact any moisture clinging to a top surface of said recessed outer section as said door is opened or closed.

3. The improved threshold system as in claim 1, wherein a top surface of said recessed outer section of said threshold plate is angled downward as said recessed outer section progresses away from said inside area and towards said outside area.

4. The improved threshold system as in claim 1, wherein said recessed outer section of said threshold plate does not extend beyond said deflector shield into said outside area.

5. The improved threshold system as in claim 1, wherein said seal flap has a select upper body profile, and wherein said door includes a seal channel adapted for engaging and securing said upper body profile of said seal flap thereto.

6. The improved threshold system as in claim 5, wherein said seal channel is removably mounted to said door.

7. The improved threshold system as in claim 1, wherein an upper section of said seal flap is secured to said door, and including:

a means for transferring only horizontal forces between said seal flap and said door; and wherein said means for transferring only horizontal forces is located below the location where said upper section of said seal flap is secured to said door.

8. An improved threshold system for sealing an inside area of a building from an outside area thereof, of the type wherein a threshold plate is disposed beneath a door, wherein the improvement comprises:

a seal flap depending from a lower area of said door, said seal flap having a first surface facing said inside area, a second surface facing said outside area, and a bottom;

said threshold plate having a raised inner section connected by an upstanding lid to a recessed outer section, said upstanding lid being located for engaging said first surface of said seal flap, thereby sealing said outside area from said inside area;

wherein said seal flap contacts said upstanding lip above said recessed outer section with sufficient height so that the seal flap does not contact any moisture clinging to a top surface of said recessed outer section as said door is opened and closed;

wherein the top surface of said recessed outer section of said threshold plate is angled downward as said recessed outer section progresses away from said inside area and towards said outside area; and wherein said seal flap and said upstanding lip are located for an engagement which allows sufficient space between the bottom of said seal flap and the top surface of said recessed outer section, and sufficient overlap between said seal flap and said upstanding lip, so that the squareness of said door can be adjusted without loss of sealing contact between said seal flap and said upstanding lip.

9. The improved threshold system as in claim 8, wherein said seal flap has a select upper body profile, and wherein said door includes a seal channel adapted for engaging and securing said upper body profile of said seal flap thereto.

10. The improved threshold system as in claim 9, wherein said seal channel is removably mounted to said door.

11. The improved threshold system as in claim 8, wherein an upper section of said seal flap is secured to said door, and including:

a means for transferring only horizontal forces between said seal flap and said door; and wherein said means for transferring only horizontal forces is located below the location where said upper section of said seal flap is secured to said door.

12. The improved threshold system as in claim 8, wherein said recessed outer section of said threshold plate does not extend beyond said door into said outside area.

13. The improved threshold system as in claim 8, including a deflector shield disposed on a lower area of said door facing said outside area, wherein said deflector shield is located for deflecting moisture and air away from said threshold system.

14. The improved threshold system as in claim 13, wherein said recessed outer section of said threshold plate does not extend beyond said deflector shield into said outside area.

15. An improved threshold system for sealing an inside area of a building from an outside area thereof, of the type wherein a threshold plate is disposed beneath a door, wherein the improvement comprises:

a seal flap depending from a lower area of said door, said seal flap having a first surface facing said inside area, a second surface facing said outside area, and a bottom;

said threshold plate having a raised inner section connected by an upstanding lip to a recessed outer section, said upstanding lid being located for engaging said first surface of said seal flap, thereby sealing said outside area from said inside area;

wherein said seal flap contacts said upstanding lip above said recessed outer section with sufficient height so that the seal flap does not contact any moisture clinging to a top surface of said recessed outer section as said door is opened and closed; and wherein said seal flap and said upstanding lip are located for an engagement which allows sufficient space between the bottom of said seal flap and the top surface of said recessed outer section, and sufficient overlap between said seal flap and said raised upper section, so that the squareness of said door can be adjusted without loss of sealing contact between said seal flap and said upstanding lip.

16. The improved threshold system as in claim 15, wherein the top surface of said recessed outer section of said threshold plate is angled downward as said recessed outer section progresses away from said inside area and towards said outside area.

17. The improved threshold system as in claim 15, wherein said recessed outer section of said threshold plate does not extend beyond said door into said outside area.

18. The improved threshold system as in claim 15, including a deflector shield disposed on a lower area of said door facing said outside area, wherein said deflector shield is located for deflecting moisture and air away from said threshold system.

19. The improved threshold system as in claim 18, wherein said recessed outer section of said threshold plate does not extend beyond said deflector shield into said outside area.

20. The improved threshold system as in claim 15, wherein said seal flap has a select upper body profile, and wherein said door includes a seal channel adapted for engaging and securing said upper body profile of said seal flap thereto.

21. The improved threshold system as in claim 20, wherein said seal channel is removably mounted to said door.

22. The improved threshold system as in claim 15, wherein an upper section of said seal flap is secured to said door, and including:

a means for transferring only horizontal forces between said seal flap and said door; and wherein said means for transferring only horizontal forces is located below the location where said upper section of said seal flap is secured to said door.

23. An improved threshold system for sealing an inside area of a building from an outside area thereof, of the type wherein a threshold plate is disposed beneath a door, wherein the improvement comprises:

a seal flap depending from a lower area of said door, said seal flap having a first surface facing said inside area, a second surface facing said outside area, and a bottom;

said threshold plate having a raised inner section connected by an upstanding lip to a recessed outer section, said upstanding lid being located for engaging said first surface of said seal flap, thereby sealing said outside area from said inside area;

wherein said seal flap contacts said upstanding lip above said recessed outer section with sufficient height so that the bottom of said seal flap does not contact a top surface of said recessed outer section as said door is opened and closed, thereby preventing wear of said seal flap caused by the rubbing of said seal flap against said top surface of said recessed outer section as said door is opened and closed; and wherein said seal flap and said upstanding lip are located for an engagement which allows sufficient space between the bottom of said seal flap and the top surface of said recessed outer section, and sufficient overlap between said seal flap and said raised upper section, so that the squareness of said door can be adjusted without loss of sealing contact between said seal flap and said upstanding lip.

24. The improved threshold system as in claim 23, wherein the top surface of said recessed outer section of said threshold plate is angled downward as said recessed outer section progresses away from said inside area and towards said outside area.

25. The improved threshold system as in claim 23, wherein said recessed outer section of said threshold plate does not extend beyond said door into said outside area.

26. The improved threshold system as in claim 23, including a deflector shield disposed on a lower area of said door facing said outside area, wherein said deflector shield is located for deflecting moisture and air away from said threshold system.

27. The improved threshold system as in claim 26, wherein said recessed outer section of said threshold plate does not extend beyond said deflector shield into said outside area.

28. The improved threshold system as in claim 23, wherein said seal flap has a select upper body profile, and wherein said door includes a seal channel adapted for engaging and securing said upper body profile of said seal flap thereto.

29. The improved threshold system as in claim 28, wherein said seal channel is removably mounted to said door.

30. The improved threshold system as in claim 23, wherein an upper section of said seal flap is secured to said door, and including:

a means for transferring only horizontal forces between said seal flap and said door; and wherein said means for transferring only horizontal forces is located below the location where said upper section of said seal flap is secured to said door.

31. An improved threshold system for sealing an inside area of a building from an outside area thereof, of the type wherein a threshold plate is disposed beneath a door, wherein the improvement comprises:

a seal flap depending from a lower area of said door, said seal flap having a first surface facing said inside area, a second surface facing said outside area, and a bottom;

a deflector shield disposed on a lower area of said door facing said outside area, said deflector shield being located for deflecting moisture and air away from said threshold system;

said threshold plate having a raised inner section connected by an upstanding lip to a recessed outer section, said upstanding lid being located for engaging said first surface of said seal flap, thereby sealing said outside area from said inside area; and said seal flap being mounted from a lower area of said door that is a surface facing said inside area of said building.

32. The improved threshold system as in claim 31, wherein said bottom of said seal flap contacts said upstanding lip above said recessed outer section with sufficient height so that the seal flap does not contact any moisture clinging to a top surface of said recessed outer section as said door is opened or closed.

33. The improved threshold system as in claim 31, wherein a top surface of said recessed outer section of said threshold plate is angled downward as said recessed outer section progresses away from said inside area and towards said outside area.

34. The improved threshold system as in claim 31, wherein said recessed outer section of said threshold plate does not extend beyond said deflector shield into said outside area.

35. The improved threshold system as in claim 31, wherein said seal flap and said upstanding lip are located for an engagement which allows sufficient space between the bottom of said seal flap and a top surface of said recessed outer section, and sufficient overlap between said seal flap and said upstanding lip, so that the squareness of said door can be adjusted without loss of sealing contact between said seal flap and said upstanding lip.

36. The improved threshold system as in claim 31, wherein said seal flap has a select upper body profile, and wherein said door includes a seal channel adapted for engaging and securing said upper body profile of said seal flap thereto.

37. The improved threshold system as in claim 36, wherein said seal channel is removably mounted to said door.

38. The improved threshold system as in claim 31, wherein an upper section of said seal flap is secured to said door, and including:

a means for transferring only horizontal forces between said seal flap and said door; and wherein said means for transferring only horizontal forces is located below the location where said upper section of said seal flap is secured to said door.

39. An improved threshold system for sealing an inside area of a building from an outside area thereof, of the type wherein a threshold plate is disposed beneath a door, wherein the improvement comprises:

a seal flap depending from a lower area of said door, said seal flap having a first surface facing said inside area, a second surface facing said outside area, and a bottom;

said threshold plate having a raised inner section connected by an upstanding lip to a recessed outer section, said upstanding lid being located for engaging said first surface of said seal flap, thereby sealing said outside area from said inside area;

wherein said seal flap contacts said upstanding lip above said recessed outer section with sufficient height so that the seal flap does not contact any moisture clinging to a top surface of said recessed outer section as said door is opened and closed; and said seal flap being mounted from a lower area of said door that is a surface facing said inside area of said building.

40. The improved threshold system as in claim 39, wherein said recessed outer section of said threshold plate does not extend beyond said door into said outside area.

41. The improved threshold system as in claim 39, including a deflector shield disposed on a lower area of said door facing said outside area, wherein said deflector shield is located for deflecting moisture and air away from said threshold system.

42. The improved threshold system as in claim 41, wherein said recessed outer section of said threshold plate does not extend beyond said deflector shield into said outside area.

43. The improved threshold system as in claim 39, wherein said seal flap and said upstanding lip are located for an engagement which allows sufficient space between the bottom of said seal flap and the top surface of said recessed outer section, and sufficient overlap between said seal flap and said raised upper section, so that the squareness of said door can be adjusted without loss of sealing contact between said seal flap and said upstanding lip.

44. The improved threshold system as in claim 39, wherein said seal flap has a select upper body profile, and wherein said door includes a seal channel adapted for engaging and securing said upper body profile of said seal flap thereto.

45. The improved threshold system as in claim 44, wherein said seal channel is removably mounted to said door.

46. The improved threshold system as in claim 39, wherein an upper section of said seal flap is secured to said door, and including:

a means for transferring only horizontal forces between said seal flap and said door; and wherein said means for transferring only horizontal forces is located below the location where said upper section of said seal flap is secured to said door.

47. An improved threshold system for sealing an inside area of a building from an outside area thereof, of the type wherein a threshold plate is disposed beneath a door, wherein the improvement comprises:

a seal flap depending from a lower area of said door, said seal flap having a first surface facing said inside area, a second surface facing said outside area, and a bottom;

said threshold plate having a raised inner section connected by an upstanding lip to a recessed outer section, said upstanding lip being located for engaging said first surface of said seal flap, thereby sealing said outside area from said inside area;

wherein said seal flap contacts said upstanding lip above said recessed outer section with sufficient height so that the seal flap does not contact any moisture clinging to a top surface of said recessed outer section as said door is opened and closed;

wherein the top surface of said recessed outer section of said threshold plate is angled downward as said recessed outer section progresses away from said inside area and towards said outside area; and said seal flap being mounted from a lower area of said door that is a surface facing said inside area of said building.

48. The improved threshold system as in claim 47, wherein said recessed outer section of said threshold plate does not extend beyond said door into said outside area.

49. The improved threshold system as in claim 47, including a deflector shield disposed on a lower area of said door facing said outside area, wherein said deflector shield is located for deflecting moisture and air away from said threshold system.

50. The improved threshold system as in claim 49, wherein said recessed outer section of said threshold plate does not extend beyond said deflector shield into said outside area.

51. The improved threshold system as in claim 47, wherein said seal flap and said upstanding lip are located for an engagement which allows sufficient space between the bottom of said seal flap and the top surface of said recessed outer section, and sufficient overlap between said seal flap and said upstanding lip, so that the squareness of said door can be adjusted without loss of sealing contact between said seal flap and said upstanding lip.

52. The improved threshold system as in claim 47, wherein said seal flap has a select upper body profile, and wherein said door includes a seal channel adapted for engaging and securing said upper body profile of said seal flap thereto.

53. The improved threshold system as in claim 52, wherein said seal channel is removably mounted to said door.

54. The improved threshold system as in claim 47, wherein an upper section of said seal flap is secured to said door, and including:

a means for transferring only horizontal forces between said seal flap and said door; and wherein said means for transferring only horizontal forces is located below the location where said upper section of said seal flap is secured to said door.

55. An improved threshold system for sealing an inside area of a building from an outside area thereof, of the type wherein a threshold plate is disposed beneath a door, wherein the improvement comprises:

a seal flap depending from a lower area of said door, said seal flap having a first surface facing said inside area, a second surface facing said outside area, and a bottom;

said threshold plate having a raised inner section connected by an upstanding lip to a recessed outer section, said upstanding lid being located for engaging said first surface of said seal flap, thereby sealing said outside area from said inside area;

wherein said seal flap contacts said upstanding lip above said recessed outer section with sufficient height so that the bottom of said seal flap does not contact a top surface of said recessed outer section as said door is opened and closed, thereby preventing wear of said seal flap caused by the rubbing of said seal flap against said top surface of said recessed outer section as said door is opened and closed; and said seal flap being mounted from a lower area of said door that is a surface facing said inside area of said building.

56. The improved threshold system as in claim 55, wherein the top surface of said recessed outer section of said threshold plate is angled downward as said recessed outer section progresses away from said inside area and towards said outside area.

57. The improved threshold system as in claim 55, wherein said recessed outer section of said threshold plate does not extend beyond said door into said outside area.

58. The improved threshold system as in claim 55, including a deflector shield disposed on a lower area of said door facing said outside area, wherein said deflector shield is located for deflecting moisture and air away from said threshold system.

59. The improved threshold system as in claim 58, wherein said recessed outer section of said threshold plate does not extend beyond said deflector shield into said outside area.

60. The improved threshold system as in claim 55, wherein said seal flap and said upstanding lip are located for an engagement which allows sufficient space between the bottom of said seal flap and the top surface of said recessed outer section, and sufficient overlap between said seal flap and said raised upper section, so that the squareness of said door can be adjusted without loss of sealing contact between said seal flap and said upstanding lip.

61. The improved threshold system as in claim 55, wherein said seal flap has a select upper body profile, and wherein said door includes a seal channel adapted for engaging and securing said upper body profile of said seal flap thereto.

62. The improved threshold system as in claim 61, wherein said seal channel is removably mounted to said door.

63. The improved threshold system as in claim 55, wherein an upper section of said seal flap is secured to said door, and including:

a means for transferring only horizontal forces between said seal flap and said door; and wherein said means for transferring only horizontal forces is located below the location where said upper section of said seal flap is secured to said door.

64. An improved threshold assembly adapted for sealing an inside area of a building from an outside area thereof, of the type wherein a threshold plate is disposed beneath a door, wherein the improvement comprises:

a seal flap depending from a lower area of said door;

a deflector shield disposed on a lower area of said door facing said outside area, whereby said deflector shield is adapted for deflecting moisture and air away from said threshold system;

said threshold plate having a raised inner section disposed towards said inside area and connected by an upstanding lip to a recessed outer section disposed towards said outside area;

said upstanding lip being adapted for engaging an area of said seal flap facing said inside area, thereby sealing said outside area from said inside area; and wherein said seal flap and said upstanding lip are adapted for an engagement which allows sufficient space between the bottom of said seal flap and a top surface of said recessed outer section, and sufficient overlap between said seal flap and said upstanding lip, so that the squareness of said door can be adjusted without loss of sealing contact between said seal flap and said upstanding lip.

65. An improved threshold assembly adapted for sealing an inside area of a building from an outside area thereof, of the type wherein a threshold plate is disposed beneath a door, wherein the improvement comprises:

a seal flap depending from a lower area of said door;

said threshold plate having a raised inner section disposed towards said inside area and connected by an upstanding lip to a recessed outer section disposed towards said outside area;

said upstanding lip being adapted for engaging an area of said seal flap facing said inside area, thereby sealing said outside area from said inside area;

wherein said seal flap contacts said upstanding lip above said recessed outer section with sufficient height so that the seal flap does not contact any moisture clinging to a top surface of said recessed outer section as said door is opened and closed;

wherein the top surface of said recessed outer section of said threshold plate is angled downward as said recessed outer section progresses away from said inside area and towards said outside area; and wherein said seal flap and said upstanding lip are adapted for an engagement which allows sufficient space between the bottom of said seal flap and the top surface of said recessed outer section, and sufficient overlap between said seal flap and said upstanding lip, so that the squareness of said door can be adjusted without loss of sealing contact between said seal flap and said upstanding lip.

66. An improved threshold assembly adapted for sealing an inside area of a building from an outside area thereof, of the type wherein a threshold plate is disposed beneath a door, wherein the improvement comprises:

a seal flap depending from a lower area of said door;

said threshold plate having a raised inner section disposed towards said inside area and connected by an upstanding lip to a recessed outer section disposed towards said outside area;

said upstanding lip being adapted for engaging an area of said seal flap facing said inside area, thereby sealing said outside area from said inside area;

wherein said seal flap contacts said upstanding lip above said recessed outer section with sufficient height so that the seal flap does not contact any moisture clinging to a top surface of said recessed outer section as said door is opened and closed; and wherein said seal flap and said upstanding lip are adapted for an engagement which allows sufficient space between the bottom of said seal flap and the top surface of said recessed outer section, and sufficient overlap between said seal flap and said raised upper section, so that the squareness of said door can be adjusted without loss of sealing contact between said seal flap and said upstanding lip

67. An improved threshold assembly adapted for sealing an inside area of a building from an outside area thereof, of the type wherein a threshold plate is disposed beneath a door, wherein the improvement comprises:

a seal flap depending from a lower area of said door;

said threshold plate having a raised inner section disposed towards said inside area and connected by an upstanding lip to a recessed outer section disposed towards said outside area;

said upstanding lip being adapted for engaging an area of said seal flap facing said inside area, thereby sealing said outside area from said inside area;

wherein said seal flap contacts said upstanding lip above said recessed outer section with sufficient height so that the seal flap does not contact a top surface of said recessed outer section as said door is opened and closed, thereby preventing wear of said seal flap caused the rubbing of said seal flap against said top surface of said recessed outer section as said door is opened and closed; and wherein said seal flap and said upstanding lip are adapted for an engagement which allows sufficient space between the bottom of said seal flap and the top surface of said recessed outer section, and sufficient overlap between said seal flap and said raised upper section, so that the squareness of said door can be adjusted without loss of sealing contact between said seal flap and said upstanding lip.

* * * * *

UNITED STATES PATENT AND TRADEMARK OFFICE

CERTIFICATE OF CORRECTION

PATENT NO. : 5,469,665

DATED : November 28, 1995

INVENTOR(S) : Lawrence Biebuyck

It is certified that error appears in the above-indentified patent and that said Letters Patent is hereby corrected as shown below:

| | | |
|---|---|---|
| Column 4, line 23 | Delete "1 edge" | Insert --ledge-- |
| Column 4, line 50 | Delete "groves" | Insert --grooves-- |
| Column 5, line 38 | Delete "reduce" | Insert --reduced-- |
| Column 8, line 2 | Delete "lid" | Insert --lip-- |
| Column 8, line 50 | Delete "lid" | Insert --lip-- |
| Column 8, line 51 | Delete "lid" | Insert --lip-- |

UNITED STATES PATENT AND TRADEMARK OFFICE

CERTIFICATE OF CORRECTION

PATENT NO. : 5,469,665

DATED : November 28, 1995

INVENTOR(S) : Lawrence Biebuyck

It is certified that error appears in the above-indentified patent and that said Letters Patent is hereby corrected as shown below:

| | | |
|---|---|---|
| Column 9, line 40 | Delete "lid" | Insert --lip-- |
| Column 10, line 32 | Delete "lid" | Insert --lip-- |
| Column 11, line 31 | Delete "lid" | Insert --lip-- |
| Column 12, line 19 | Delete "lid" | Insert --lip-- |
| Column 14, line 3 | Delete "lid" | Insert --lip-- |

Signed and Sealed this

Twenty-eighth Day of January, 1997

*Attest:*

Bruce Lehman

BRUCE LEHMAN

*Attesting Officer*

*Commissioner of Patents and Trademarks*